US008845446B2

(12) United States Patent
Talbot

(10) Patent No.: US 8,845,446 B2
(45) Date of Patent: Sep. 30, 2014

(54) GOLF SWING CONTROL APPARATUS

(71) Applicant: Matthew R. Talbot, Marlborough, CT (US)

(72) Inventor: Matthew R. Talbot, Marlborough, CT (US)

( * ) Notice: Subject to any disclaimer, the term of this patent is extended or adjusted under 35 U.S.C. 154(b) by 0 days.

(21) Appl. No.: 13/754,977

(22) Filed: Jan. 31, 2013

(65) Prior Publication Data

US 2013/0203515 A1 Aug. 8, 2013

Related U.S. Application Data

(60) Provisional application No. 61/632,995, filed on Feb. 3, 2012, provisional application No. 61/633,769, filed on Feb. 17, 2012.

(51) Int. Cl.

| | |
|---|---|
| ***A63B 69/36*** | (2006.01) |
| ***A63B 69/00*** | (2006.01) |
| *A63B 71/06* | (2006.01) |

(52) U.S. Cl.

CPC ..... *A63B 69/3608* (2013.01); *A63B 2209/10* (2013.01); *A63B 69/0059* (2013.01); *A63B 2069/0008* (2013.01); *A63B 69/36* (2013.01); *A63B 2071/0694* (2013.01)

USPC ..... 473/212; 473/213; 473/276

(58) Field of Classification Search

USPC ..... 473/206, 212, 213, 214, 227, 276

See application file for complete search history.

(56) References Cited

U.S. PATENT DOCUMENTS

| | | | | |
|---|---|---|---|---|
| 5,145,179 | A * | 9/1992 | Breed | 473/212 |
| 5,203,568 | A * | 4/1993 | Vasquez | 473/212 |
| 5,259,621 | A * | 11/1993 | Keefer | 473/212 |
| 5,447,312 | A * | 9/1995 | Nixon et al. | 473/212 |
| 5,711,716 | A * | 1/1998 | O'Brien et al. | 473/212 |
| 5,904,624 | A * | 5/1999 | Martinez | 473/212 |
| 7,033,284 | B2 * | 4/2006 | Yoshimura | 473/276 |
| 7,699,714 | B1 * | 4/2010 | Reynolds | 473/212 |

* cited by examiner

*Primary Examiner* — Nini Legesse

(74) *Attorney, Agent, or Firm* — Donald J. MacDonald; Coleman & MacDonald Law Office

(57) ABSTRACT

A swing aid for controlling the movement of a sports stick during a swing is disclosed. The swing aid includes a trailing member, a leading member, and a joining member connecting the trailing member to the leading member. The leading member and the trailing member each have an axis that intersect one another at an axis intersection point located within the joining section, the axes thereby defining an obtuse angle.

17 Claims, 8 Drawing Sheets

GOLF SWING CONTROL APPARATUS

CROSS-REFERENCES TO RELATED APPLICATIONS

This application claims priority to and the benefits of under 35 U.S.C. 119(e) U.S. Provisional Patent Application No. 61/632,995, titled UNIVERSAL SWINGS 23.5° TRAINING, filed on Feb. 3, 2012, the contents of which is incorporated by reference herein in its entirety. This application also claims priority to and the benefits under 35 U.S.C. 119 (e) U.S. Provisional Patent Application No. 61/633,769, also titled UNIVERSAL SWINGS 23.5° TRAINING, filed on Feb. 17, 2012, the contents of which is incorporated herein by reference in its entirety.

FIELD

The aspects of the present disclosure relate generally to controlling arm movement during a sports stick swing. More specifically, the present disclosure relates to controlling the positional relationship between a user's arms while swinging a golf club or bat so as to control a hit ball.

BACKGROUND

Large numbers of people have taken up golf in recent years. Significant numbers of golfers/athletes have difficulty controlling their club swing, and experience considerable difficulty putting a ball where intended. Difficulty in hitting the ball to land at an intended location lessens their enjoyment of the game.

Even though many golfers seek out the advice of an instructor to improve their golf game, mastery of a good golf swing requires considerable practice and discipline. Unfortunately, without an accurate and consistent swing, many golfers/athletes find the game frustrating as some shots arrive near their intended target, while others, seemingly made with exactly the same swing mechanics, land in the rough or far away from an intended target. Such experiences may be cumulative, discouraging some golfers because they cannot repeatedly execute the golf swing that produces their occasional ideal shot. And while the old saw that it only takes a single good shot during a round of golf to bring the player back for a successive round largely holds true, considerable numbers of players abandon the game due to an inconsistent swing.

A proper golf swing requires coordination between the golfer's arms and the upper and lower portions of the golfer's torso. Several devices have been proposed to improve a golfer's swing. Some of these devices work some extent, while others in effect hinder golfers from learning a proper swing. All these devices, however, neglect one or more features of the arrangement of the swinger's arm that the Applicant has found are critical to controlling a hit ball.

For example, at least one device attempts to coordinate the upper and lower body movement by connecting one of the golfer's shoulders to an opposing hip. Another device attaches to both the golfer's upper arms and encircles the golfer's upper body. Each of these devices, while somewhat effective in removing certain defects from a golfer's swing, fail to adequately control the arrangement of a golfer's arms, upper torso, and lower torso such that the swing in consistent enough throughout the swing so as to provide adequate swing control.

Consequently, there is a need for an apparatus that conditions the sportsman to maintain consistent relative arm placement during the motion of the swing of a sports stick such as a golf club or bat. The apparatus should control the placement of the arms relative to one another such that the swing is both controllable, repeatable, and such that a hit ball at least one of travels in a desired direction, travels in a desired trajectory, or arrives in proximity to a desired location. The apparatus should also assist the golfer in developing muscle memory that enables the sportsman to swing consistently without the apparatus after a period of training with the apparatus.

BRIEF DESCRIPTION OF EMBODIMENTS

A swing aid is described. The swing aid includes a trailing member, a leading member, and a joining member connecting the trailing member to the leading member. The leading member and the trailing member each have an axis that intersect one another at an axis intersection point located within the joining section, the axes thereby collectively defining an obtuse angle.

In an embodiment, the swing aid comprises a trailing member having a trailing member axis, a leading member having a leading member axis, and a joining member having an axes intersection point. The joining member couples the trailing member to the leading member such that the trailing member axis intersects the leading member axis at the axes intersection point. At least one of the leading member and the trailing member further comprises a first strap with a fixable surface, and a second strap with an opposed fixable surface. The fixable surface and the opposed fixable surface are configured to define an aperture extending through the at least of the leading member and trailing member.

BRIEF DESCRIPTION OF THE DRAWINGS

The foregoing and other advantages and features of the invention will become apparent upon reading the following detailed description and upon reference to the drawings in which.

DETAILED DESCRIPTION OF SPECIFIC EMBODIMENTS

Detailed illustrative embodiments of a swing aid are disclosed herein. While specific configurations and arrangements of the swing aid and related methods are discussed, it should be understood that these are for illustrative purposes only. A person skilled in the pertinent art will recognize that other configurations and arrangements can be used without departing from the spirit and scope of the present description. Moreover, it will also be apparent to a person skilled in the pertinent art that the apparatus and method disclosed herein may also be employed in applications beyond those explicitly discussed herein.

It will further be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

Various embodiments of the swing aid for control of a golf swing are discussed for illustrative purposes only. Embodiments of the swing aid may also be used in other applications where relative arm position during a swing of a sports stick contributes to the direction, trajectory, and placement of a hit ball. For example, embodiments of the swing aid disclosed herein control the intra arm angle of a user of a baseball or softball bat such that a hit ball at least one travels in a desired direction, travels in a desired direction, or arrives at an intended location.

Figure 1:
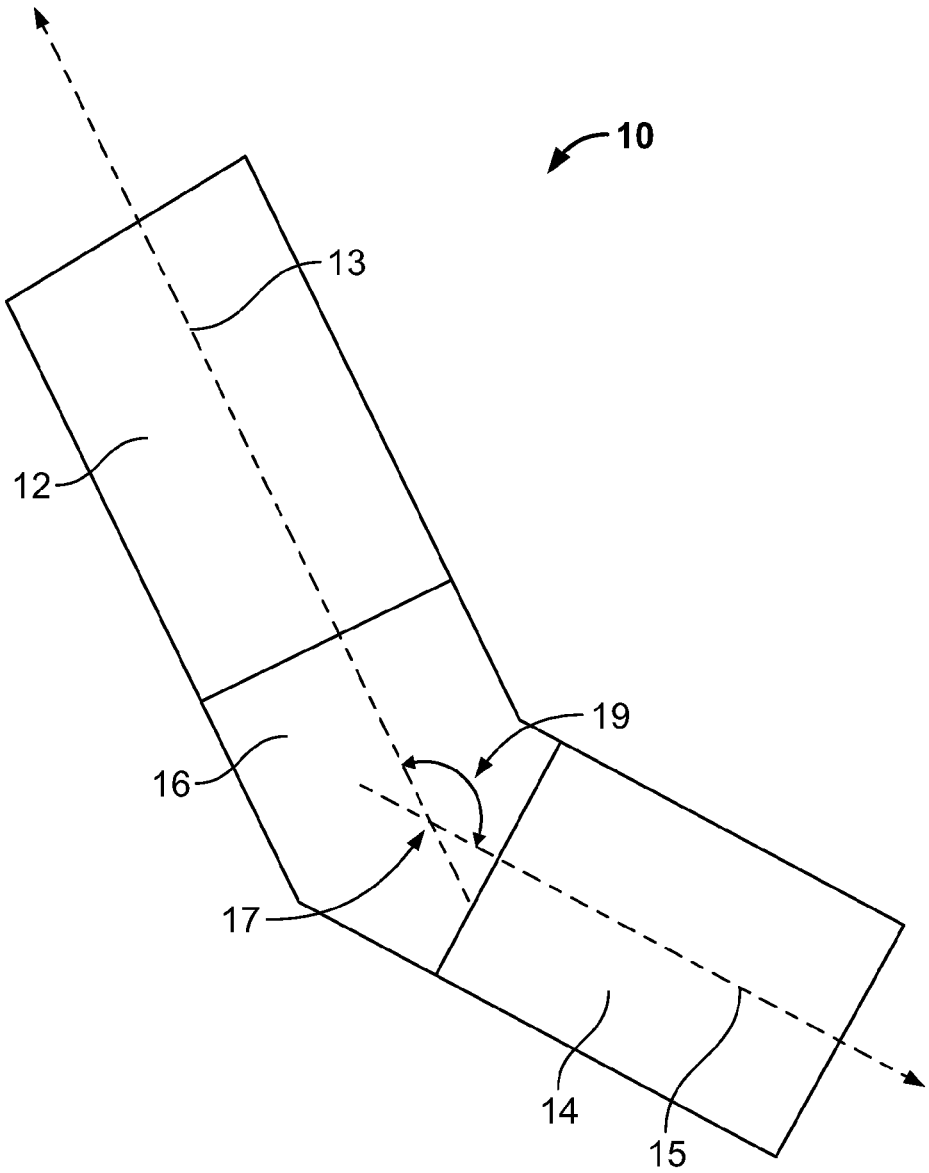
FIG. 1 shows a plan view of an embodiment of a swing aid.

FIG. 1 shows a plan view of an embodiment of a swing aid 10. Swing aid 10 comprises a trailing member 12, a leading member 14, and a joining member 16. Trailing member 12 defines a trailing member axis 13, axis 13 substantially bisecting trailing member 12 and extending into the joining member 16. Joining member 16 couples trailing member 12 to leading member 14 such that the members (12,14,16) form a single assembly defining swing aid 10.

Leading member 14 defines a leading member axis 15, axis 15 substantially bisecting leading member 14 and extending into the joining member 16. The trailing member axis 13 and the leading member axis 15 intersect at an intersection point 17 located within a plane defined by the joining member 16. Intersecting axes 13 and 15 further define a critical angle 19 therebetween. In an embodiment, the leading member 14 and trailing member are configured to engage a user's arms such that the leading member axis 15 is substantially orthogonal to an axis of a first arm of the user and the trailing member axis 13 is substantially orthogonal to an axis of a second arm of the user. Critical angle 19 defines an obtuse angle, and in an embodiment, defines an angle greater than or equal to 151.5° and less than or equal to 161.5° and all subranges therebetween, or, more specifically, defines an angle greater than or equal to 155.5° and less than or equal to 157.5°, or, even more specifically, critical angle 19 defines an angle of about 156.5°. In yet another embodiment, the critical angle 19 is in a range of about 150° to 160°. In still another embodiment, the critical angle 19 is in a range of about 140° to 170°. Advantageously, these ranges allow a user to swing a sport stick having slightly bent arms at the elbow which would create a slightly larger angle.

Applicant recognizes that the best sport stick swingers in the world swing with an intra-arm angle between 23° to 24°, the intra-arm angle being an angle formed by the intersection of the club swinger's arms when holding a golf club or a bat. For example, Applicant's analysis of accomplished golfer Ben Hogan's swing shows a consistent relative arm placement whereby the arms maintain an intra-arm angle of about 23.5° throughout the club swing. Similarly, Applicant's analysis of accomplished baseball player Jose Cruz's swing shows a consistent relative arm placement whereby the arms maintain an intra-arm angle of about 23.5° throughout the club swing. Applicant has likewise identified other professional athletes that swing sport sticks using an intra-arm angle of around this value. In one embodiment, swing aid 10 advantageously urges the user's arms such that the user maintains an intra-arm angle between about 23° and about 24°, and optimally 23.5°. In one embodiment, swing aid 10 allows the user to develop sufficient muscle memory to maintain such an angle range without the swing aid following a comparatively short period of training with swing aid 10.

Figure 2:
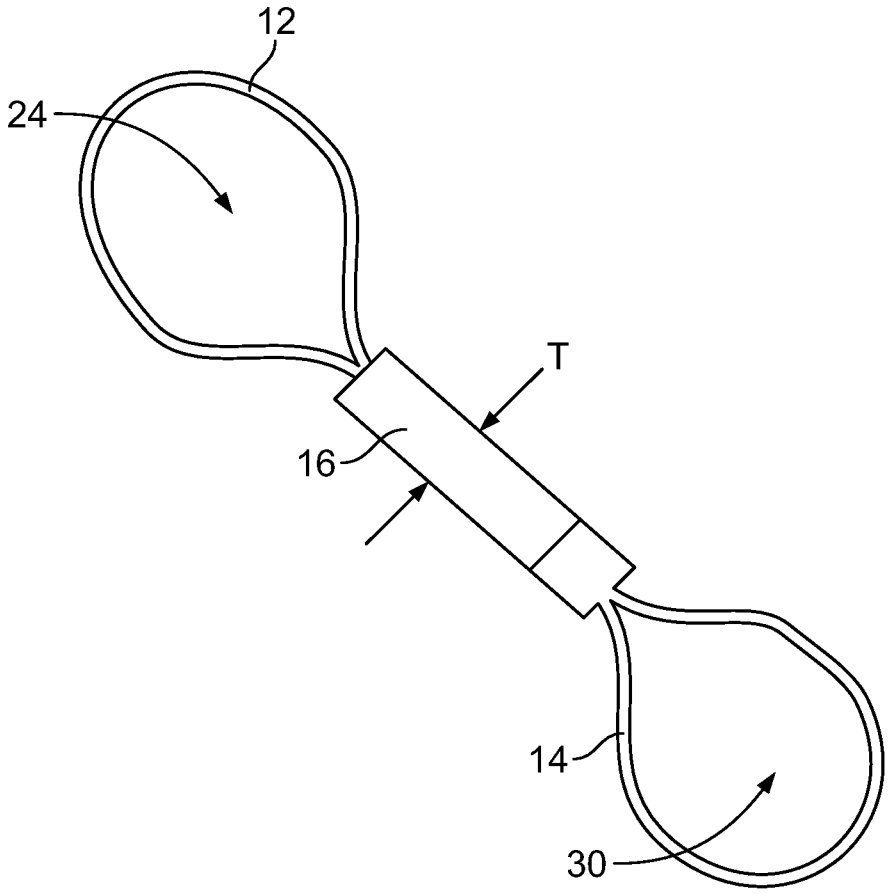
FIG. 2 shows a profile view of an embodiment of a swing aid.

FIG. 2 shows a profile view of an embodiment of the swing aid 10. As shown in FIG. 2, trailing member 12 defines a trailing aperture 24 configured to receive an arm of a user of swing aid 10. Similarly, leading member 14 defines a leading aperture 30 configured to receive an arm of a user of swing aid 10. Joining member 16 further comprises a thickness T, thickness T being greater than a respective width of trailing member 12 and/or leading member 14.

In the embodiment of swing aid 10 shown in FIG. 2, the swing aid is constructed of an elastic material such as Lycra® or Spandex® available from DuPont Corporation of Wilmington, Del. Advantageously, constructing trailing member 12 and/or leading member 14 from an elastic material allows for the material to conform to the changing shape of a user's arm during a swing. Advantageously, embodiments of swing aid 10 are constructed such that at least one of the apertures 24 and 30 further comprises a diameter smaller than a diameter of the user's arm such that swing aid 10 engages the user arm with sufficient force to maintain the above-discussed intra-arm angle and without otherwise interfering with the user's swing mechanics. Advantageously, the user is able to swing a sports stick with a natural, fluid motion with a consistent intra-arm angle defined by the critical angle of the swing aid.

Figure 3:
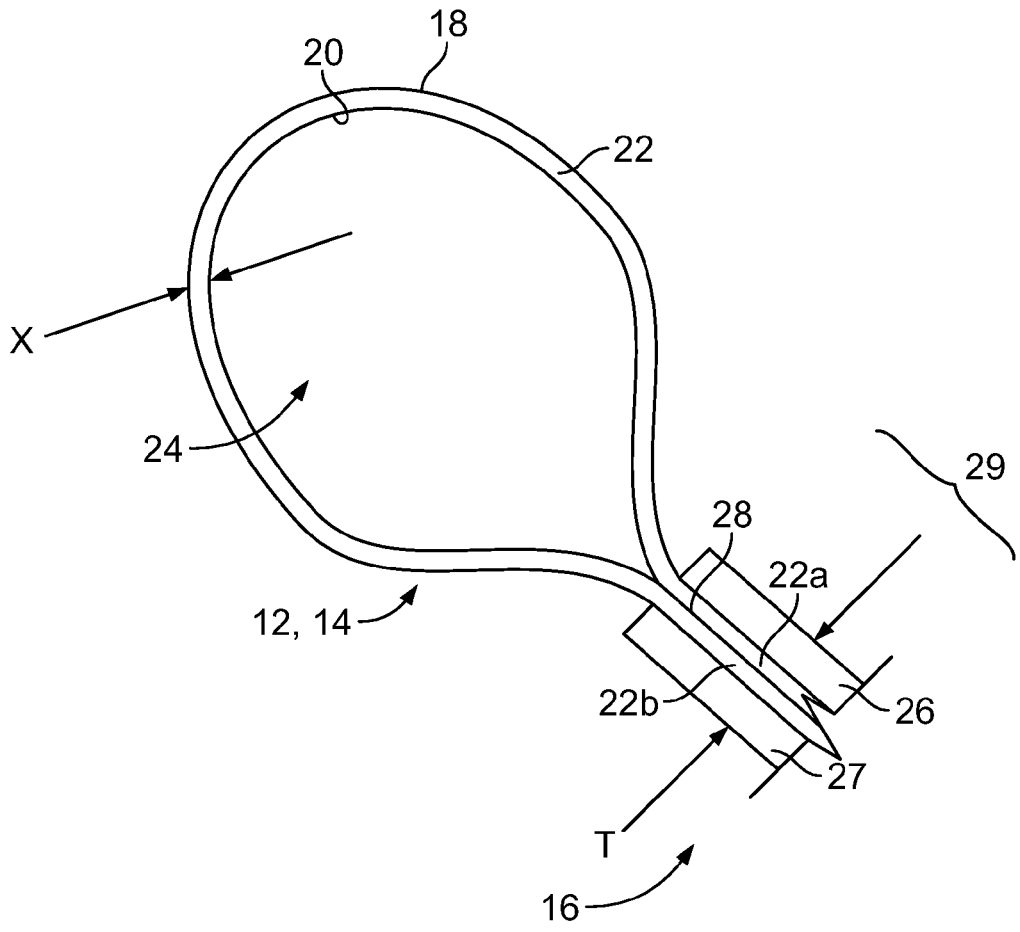
FIG. 3 shows a profile view of a trailing member and a portion of a joining member of an embodiment of a swing aid.

FIG. 3 shows a profile view of the trailing member 12 and a portion of the joining member 16 of an embodiment of the swing aid 10. Trailing member 12 comprises a strap 22 having a thickness t, an inner surface 18, and an outer surface 20. Joining member 16 comprises a stacked keeper assembly 29, the assembly having top section 26, an upper strap portion 22*a*, a lower strap portion 22*b*, and a lower section 27. The top section 26 and bottom section 27 cooperatively exert a compressive force on the upper and lower strap portions (22*a*, 22*b*), urging the portions together along an axial length of the keeper assembly 29 and defining an upper and lower strap interface region 28. As will be recognized by one of skill in the art in view of this written description, in an embodiment, the leading member 14 comprises the same construction and has a mirrored arrangement with respect to the trailing member 12.

In an embodiment, the compressive force exerted by the keeper assembly 29 is such that the portions of strap inner surface 18 engaged by the keeper 29 do not translate relative to one another. Instead, the joined portions (22*a*, 22*b*) axially deform with corresponding translations. For example, the keeper assembly 29 may axially stretch upon application of appropriate force. In another embodiment, the keeper assembly 29 is configured such that the interface region 28 is substantially fixed irrespective of an axial force applied to the assembly, a length of the interface region 28 remaining fixed during a user's swing of a golf club or baseball bat.

In one embodiment, the keeper assembly 29 comprises a folder (shown in FIG. 5) that wraps around the upper and lower strap portions (22*a*, 22*b*) on at least three sides. In an embodiment, the keeper assembly 29 is constructed from a material having less elasticity than at least one of the leading member 14 and trailing member 12, thereby advantageously substantially limiting 'give' in the assembly to the portions directly contacting the user's arms. In an embodiment, the keeper assembly 29 couples to the strap portions (22*a*,22*b*) using an adhesive, thereby fixing the otherwise elastic portions to a rigid structure and defining an interface region 28 having a fixed axial length.

However, as would be recognized by one of skill in the art in view of the disclosure herein, other materials and means of fixation are within the scope of Applicant's disclosure such a plastics and/plastic compression fittings. In an embodiment, the keeper assembly 29 is stitched to the strap with stitching extending about at least a portion of the periphery of the keeper.

Figure 4:
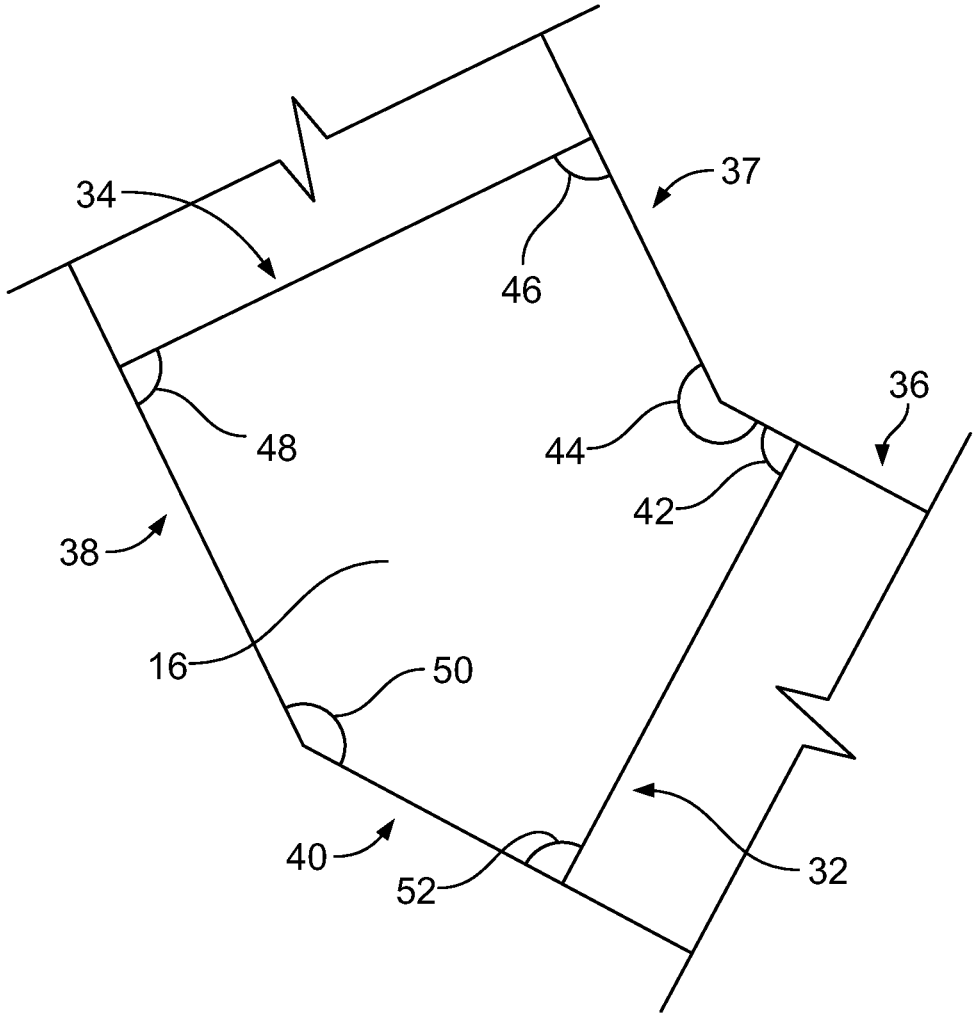
FIGS. 4-6 show plan views of embodiments a joining member of a swing aid.
Figure 5:
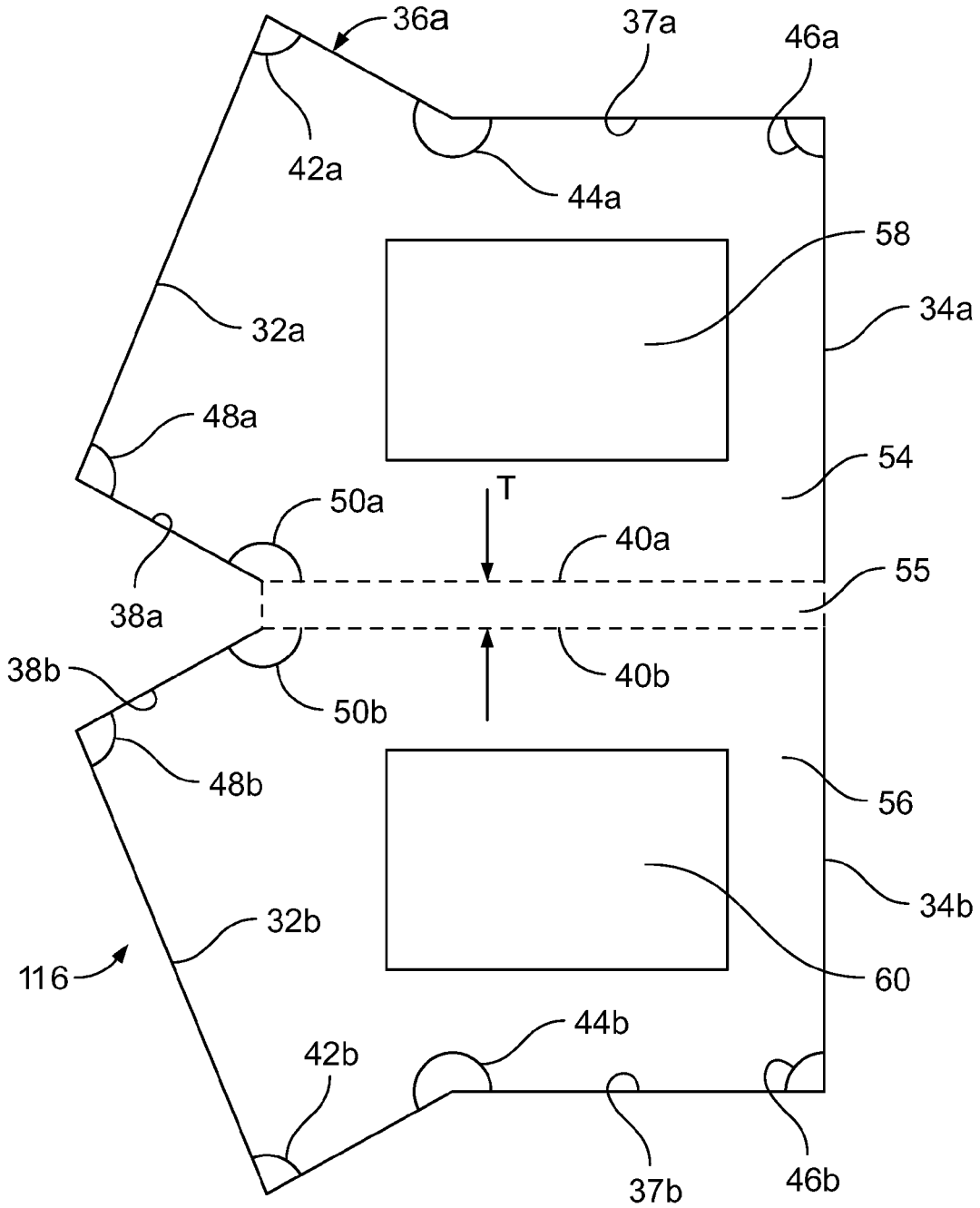
Figure 6:
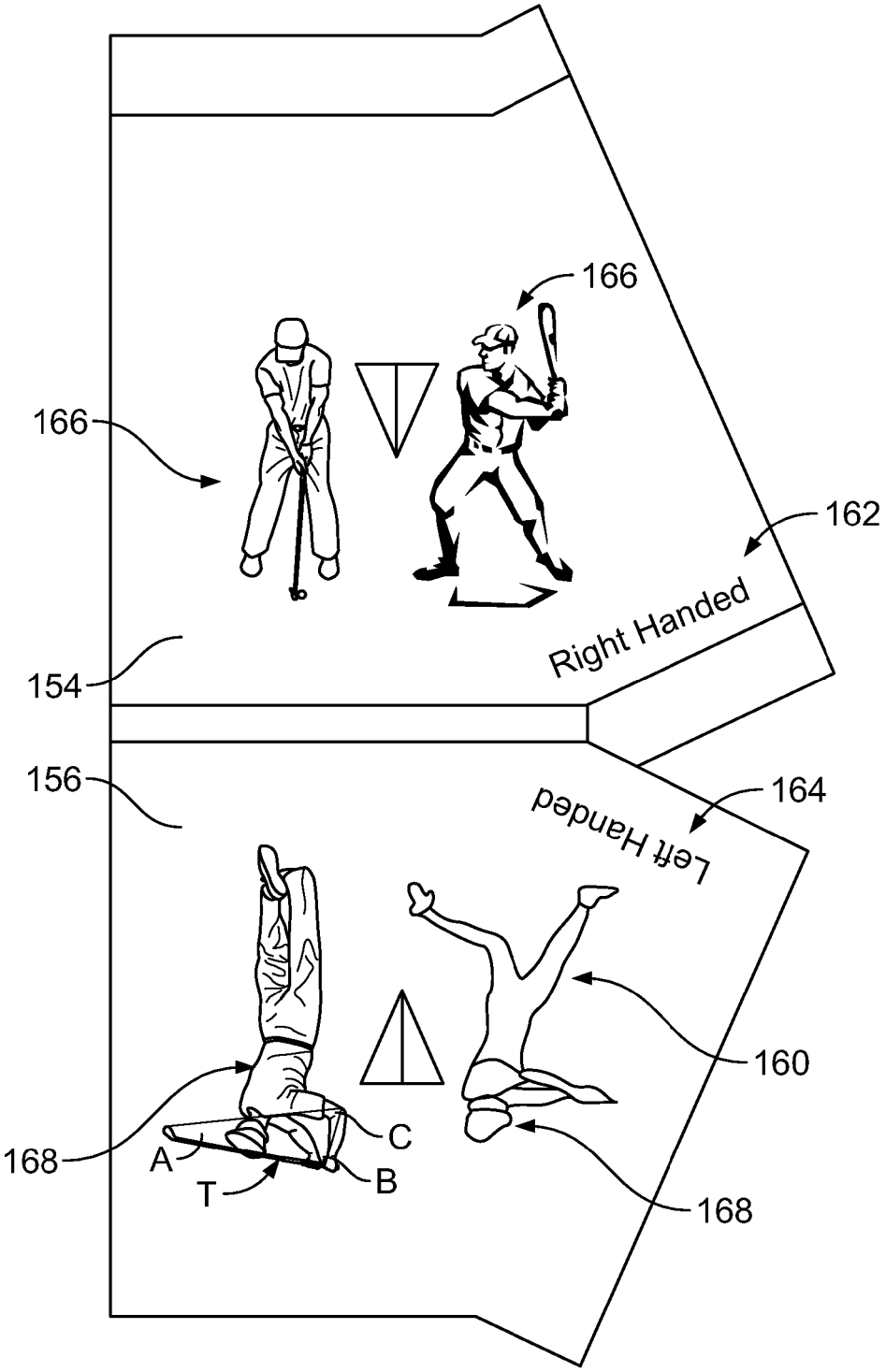

FIGS. 4-6 show plan views (top down) of embodiments the joining member 16 of a swing aid 10.

FIG. 4 is a plan view of joining member 16. Joining member 16 comprises a trailing edge 34, a leading edge 32, a leading front edge 36, a trailing front edge 37, a trailing back edge 38, and a leading back edge 40. A respective terminus of each edge (32,34,36,38,40) intersects a respective terminus of a different edge (32,34,36,38,40) such that the joining member periphery defines a hexagonal polygon. In an embodiment, the joining member defines, in three-dimensions, a hexahedron including edges having a length of T corresponding to the thickness of joining member 16. In an embodiment, the thickness T of the joining member is substantially the same throughout a motion of the swing aid user.

As shown in FIG. 4, the joining member edges (32,34,36,38,40) define angles at their respective intersections. An intersection of the leading edge 32 and the leading front edge 36 defines a first angle 42. An intersection of the leading front edge 36 and the trailing front edge 37 defines a second angle 44. An intersection of the trailing front edge 37 and the trailing edge 34 defines a third angle 46. An intersection of the trailing edge 34 and the trailing back edge 38 defines a fourth angle 48. An intersection of the trailing back edge 38 and the leading back edge 40 defines a fifth angle 50. An intersection of the leading back edge 40 and the leading edge 32 defines a sixth angle 52. In an embodiment, the first angle 42 is about 90°. In an embodiment, the second angle 44 is about 156.5°. In an embodiment, the third angle 46 is about 90°. In an embodiment, the fourth angle 48 is about 90°. In an embodiment, the fifth angle 50 is about 156.5°. In an embodiment, the sixth angle 52 is about 90°. Advantageously, in an embodiment with the first angle 42 is about 90°, the second angle 44 is about 156.5°, the third angle 46 is about 90°, the fourth angle 48 is about 90°, the fifth angle 50 is about 156.5°, and the sixth angle 52 is about 90°, the intersection of the axes of the trailing member 14 and leading member 14 define an angle of about 156.5°. Advantageously, an axes critical angle of about 156.5° controls the intra-arm angle of the user's swing such that the user maintains an angle of about 23.5° throughout the swing.

FIG. 5 is a plan view of a folder 116. Folder 116 comprises a first surface 54 and a second surface 56, the surfaces (54,56) defining mirroring hexagonally-shaped portions and a substantially rectangular side portion 55. Rectangular side portion 55 has a height substantially equal to the thickness of the straps shown in FIG. 3. At least one of the surfaces (54,56) further comprises a label. As shown in the illustrated embodiment, the first surface 54 comprises a first surface label 58 and the second surface 56 comprises a second surface label 60.

First surface 54 comprises a trailing edge 34*a*, a leading edge 32*a*, a leading front edge 36*a*, a trailing front edge 37*a*, a trailing back edge 38*a*, and a leading back edge 40*a*. An intersection of the leading edge 32*a* and the leading front edge 36*a* defines a first angle 42*a*. An intersection of the leading front edge 36*a* and the trailing front edge 37*a* defines a second angle 44*a*. An intersection of the trailing front edge 37*a* and the trailing edge 34*a* defines a third angle 46*a*. An intersection of the trailing edge 34*a* and the trailing back edge 38*a* defines a fourth angle 48*a*. An intersection of the trailing back edge 38*a* and the leading back edge 40*a* defines a fifth angle 50*a*. An intersection of the leading back edge 40*a* and the leading edge 32*a* defines a sixth angle 52*a*.

Second surface 56 correspondingly comprises a trailing edge 34*b*, a leading edge 32*b*, a leading front edge 36*b*, a trailing front edge 37*b*, a trailing back edge 38*b*, and a leading back edge 40*b*. An intersection of the leading edge 32*b* and the leading front edge 36*b* defines a first angle 42*b*. An intersection of the leading front edge 36*b* and the trailing front edge 37*b* defines a second angle 44*b*. An intersection of the trailing front edge 37*b* and the trailing edge 34*b* defines a third angle 46*b*. An intersection of the trailing edge 34*b* and the trailing back edge 38*b* defines a fourth angle 48*b*. An intersection of the trailing back edge 38*b* and the leading back edge 40*b* defines a fifth angle 50*b*. An intersection of the leading back edge 40*b* and the leading edge 32*b* defines a sixth angle 52*b*.

In the embodiment of folder 116 shown in FIG. 5, corresponding angles of the first surface 54 and the second surface 56 are substantially equal to one another. For example, first angles 42*a* and 42*b* are substantially congruent to one another. Similarly, second angles 44*a* and 44*b* are substantially congruent to one another. Likewise, third angles 46*a* and 46*b* are substantially congruent to one another. Similarly, fourth angles 48*a* and 48*b* are substantially congruent to one another. Likewise, fifth angles 50*a* and 50*b* are substantially congruent to one another. Similarly, sixth angles 52*a* and 52*b* are substantially congruent to one another. In an embodiment, first angles 42*a* and 42*b* are about 90°, second angles 44*a* and 44*b* are about 156.5°, third angles 46*a* and 46*b* are about 90°, fourth angles 48*a* and 48*b* are about 90°, fifth angles 50*a* and 50*b* are about 156.5°, and sixth angles 52*a* and 52*b* are about 90°. Advantageously, the folder 116 angles and thickness T cooperate to accommodate a thickness of the material from which joining member 16 is constructed. This arrangement serves to fix the upper and lower strap portions 22*a*, 22*b* (shown in FIG. 3) in three dimensions, the axes 13 and 15 (shown in FIG. 1) thereby intersect at an angle of about 156.5° in the illustrated embodiment, thereby allowing for control of a user's swing intra-arm angle to substantially about 23.5° during the user's swing.

FIG. 6 shows an embodiment of folder 116 having a first surface 158 with a first surface label 160. Label 158 comprises a training aid 166 showing the target mechanics of a swing. Label 158 further comprises orientation indicia 162. When a user places the swing aid 10 in an orientation such that label 154 faces upwards, advantageously allowing showing the user that the aid 10 is arranged for left-handed swing training. In an embodiment, folder 116 further comprises a second surface 160 with a second surface label 164. Label 164 further comprises orientation indicia 164. When a user places the swing aid 10 in an orientation such that label 156 faces upwards, orientation indicia 164 is readable by the user, advantageously showing the user that the aid 10 is arranged for right-handed swing training Advantageously, orientation indicia (162,164) enable swing aid 10 to be reversible, the swing-aid thereby being configured to control both left-handed swings and right handed swings by maintaining about a 23.5° intra-arm angle throughout the swing.

Figure 7:
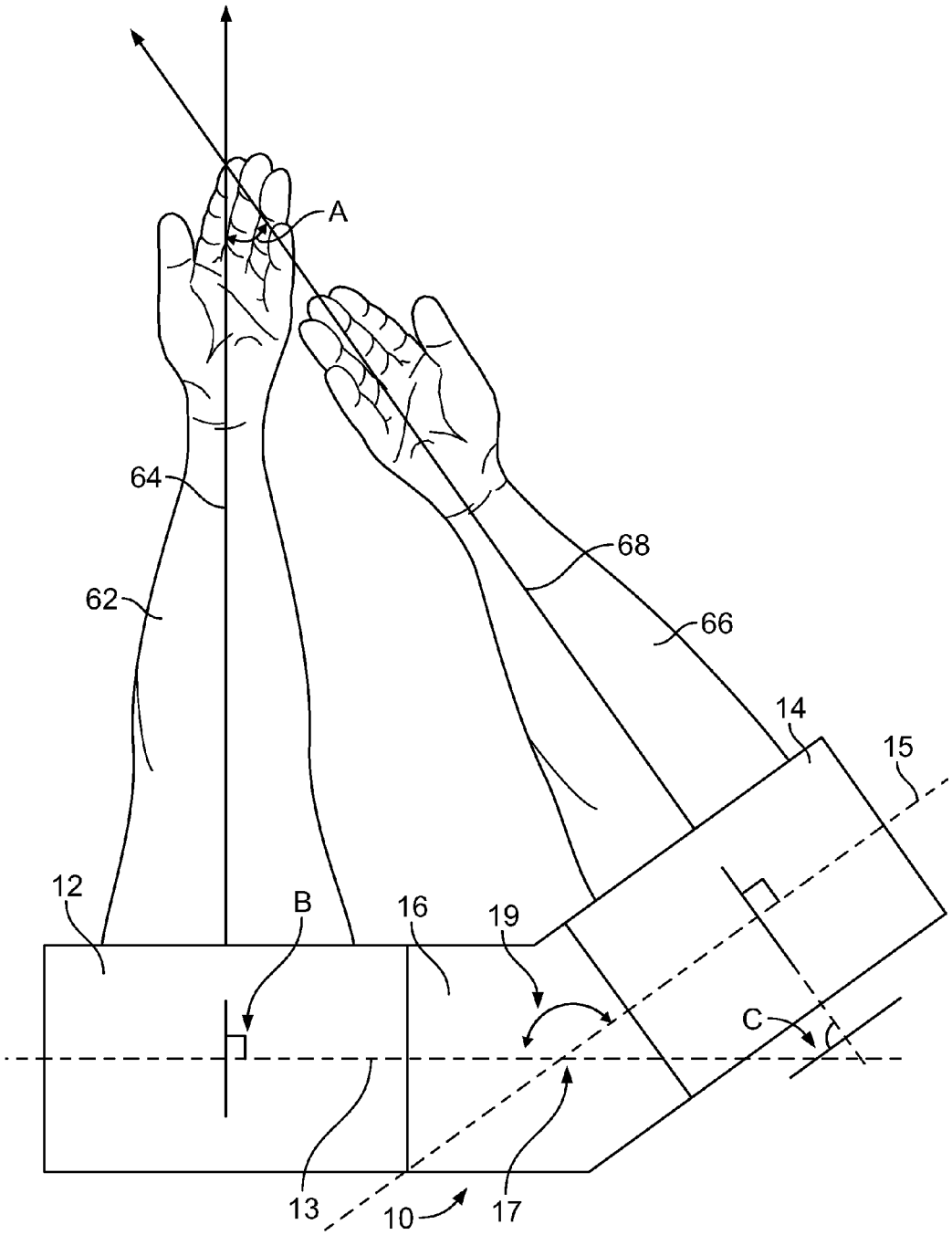
FIG. 7 operatively illustrates use of a swing aid and shows the placement of the aid over left and right arms of a right-handed individual for swinging a baseball bat or golf club.

FIG. 7 operatively illustrates use of a swing aid 10 and shows a positioning of the aid 10 over left 62 and right 68 arms of a right-handed individual swinging a baseball bat or golf club. As shown in FIG. 7, a swing aid user has inserted their left arm 62 through the aperture (not shown) defined by the trailing member 12 such that an axis 64 of the user's left arm is substantially orthogonal to the trailing member axis 13. The user has also inserted their right arm 66 through the aperture (not shown) defined by the leading member 14 such that an axis 68 of user's right arm is substantially orthogonal to leading member axis 15.

Advantageously, the critical angle 19 of the swing aid conforms (e.g. controls) the positional relationship of the user's arms (62,66) such that the user arm axes (64,68) intersect at an angle A, the trailing member axis 13 intersects the right arm axis 68 at an angle C, and left arm axis 64 intersects the trailing member axis at an angle B. Where swing aid is configured with a critical angle of about 156.5°, angle A is about 23.5°, angle B is about 90°, and angle C is about 66.5°. Swing aid 10 establishes a positional relationship between the user's arms consistent with the measurements taken from the Applicant's observations of right-handed professional golfers and baseball players. A main focus of the swing aid 200 is to control a user to maintain a right triangle in the arm swing of 90°×23.5°×66.5° throughout the entire swing motion from start to finish as shown in the follow through position of the athletes' 168 arms of FIG. 6. The triangle T shown in FIG. 6 includes an angle A of about 23.5°, the angle B is about 90°, and angle C is about 66.5°. As would be recognized by one of skill in the art in view of the teachings herein, reversing the swing aid 10 such that leading member 14 is positioned on the user's left arm 62 and trailing member 12 is positioned on the user's right arm 66 causes the arms to adopt a similar arrangement for a left-handed user, thereby conforming the positional relationship of a left-handed swinger arms such that an intra-arm angle of about 23.5° is maintained.

Figure 8:
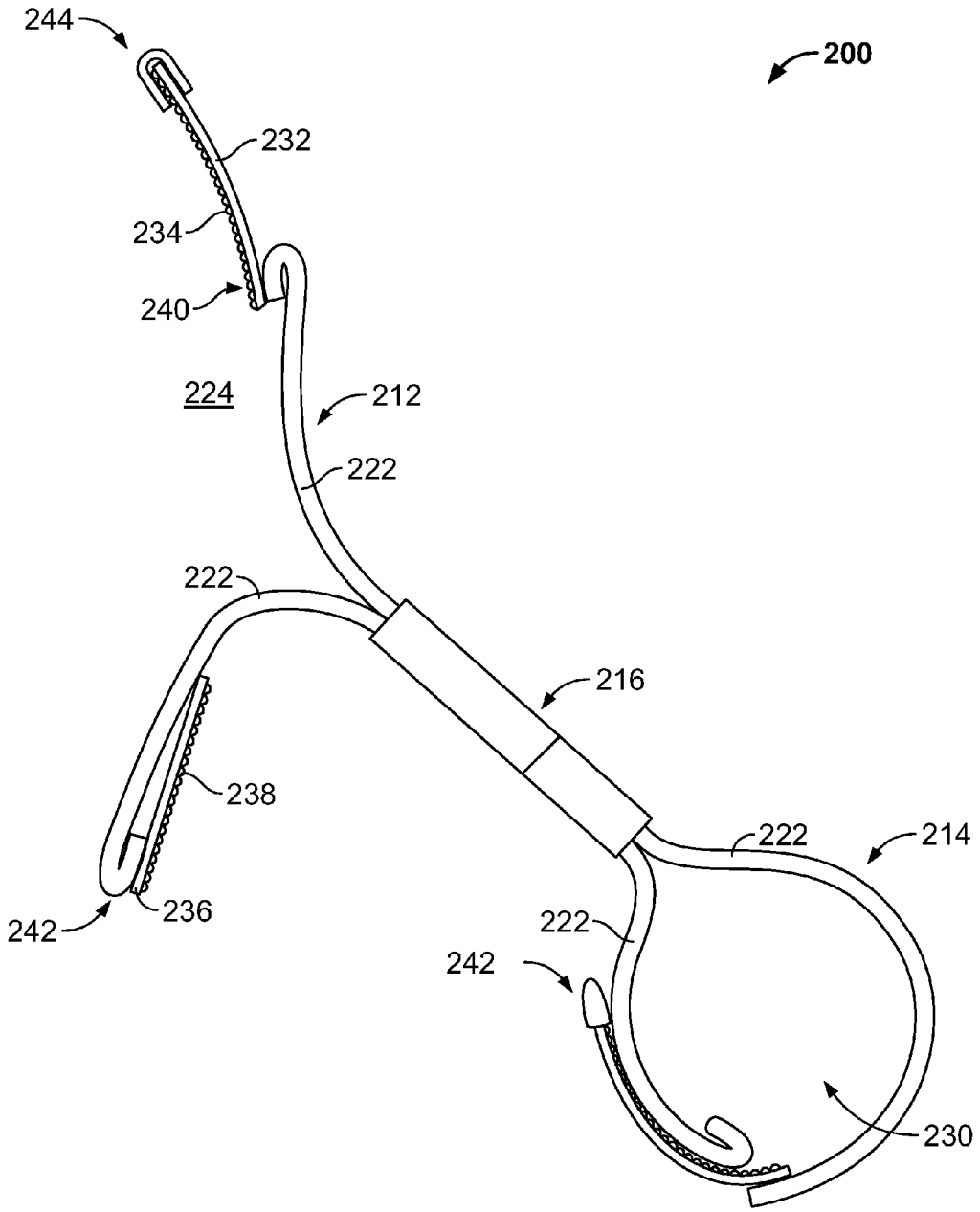
FIG. 8 shows an embodiment of a swing aid having adjustable leading and trailing members.

FIG. 8 shows an embodiment of an adjustable swing aid 200. Swing aid 200 comprises a trailing member 212, a leading member 214, and a joining member 216. The joining member 216 couples the trailing member 212 to the leading member 214. Leading member 214 (shown in an adjusted configuration) is configured to define a first arm aperture 230. Trailing member 212 (shown in an unadjusted configuration) is configured to define a second arm aperture 224. As with the above-described swing aid 10, when a user wears the swing aid 200 with the user's right arm extending through the aperture 230 of the leading member 214 and the user's left arm extending through the aperture 224 of trailing member 212, swing aid 200 is configured to conform a right-handed swing with an intra-arm angle of about 23.5°. Where swing aid 200 is flipped upside down relative to the orientation shown in FIG. 8, and a user wears the swing aid 200 with the user's left arm extending through the aperture 230 of the leading member 214, and the user's right arm extending through the aperture 224 of trailing member 212. In this arrangement, swing aid 200 similarly conforms a left-handed swinger's swing with an intra-arm angle of about 23.5°.

Trailing member 212 further comprises a first strap 232 having a fixable surface 234 and a second strap 236 having an opposed fixable surface 238. First strap 232 couples to the strap 222 at first strap end 240. Second strap 236 couples to the strap 222 at second end 242. The fixable surfaces are configured such that the surfaces (234,236) may be releasably engaged along a user-selected length, thereby allowing the user to define a circumference of the arm aperture 224. In the embodiment, both the leading and the trailing members are shown having adjustable straps. In another embodiment, only one of the leading member and trailing member comprises first and second straps having fixable opposed surfaces. In an embodiment, at least one of the first and second straps further comprises a leading or trailing arm indicia orientation marking comprising at least one of direction arrows, angle, a fulcrum triangle, and left-handed or right-handed swing orientation.

In an embodiment (not shown) the strap 22 further comprises an axial discontinuity about the aperture 24. The axial discontinuity comprises an adjustable connection such that diameter of aperture 24 may be changed to suit the arm diameter of a specific user. In an embodiment, the adjustable connection comprises a joinable, two-piece Velcro® strap.

FIG. 9 shows an embodiment of a swing aid having both a forearm member and an upper arm member for controlling arm placement while swinging a golf club or baseball bat. Swing aid 300 comprises a forearm member 302, an upper arm member 304, and a joining member 316 connecting the forearm member 302 and the upper arm member 304. The forearm member 302 has a trailing member 310 and a leading member 312, the joining member 316 connecting the trailing member 310 to the leading member 312. The upper arm member 304 has a trailing member 306 and a leading member 308, the joining member 316 connecting the trailing member 306 to the leading member 308. Trailing members (310,306) define a first set of apertures, the apertures being configured to respectively receive the user's left forearm and left upper arm, and user's left elbow being disposed in a gap defined between opposed edges of the trailing members. Leading members (312,308) correspondingly define a second set of apertures, the apertures being configured to respectively receive the user's right forearm and right upper arm, and user's right elbow being disposed in a gap defined between opposed edges of the leading members. Advantageously, swing aid 300 controls the relative placement of the user's left arm and right arm such that the arm axes define angles A, B, and C with a critical angle 319 defined on each of the forearm and upper arm members (302,304). In an embodiment, the critical angle is about 156.5°, angle A is about 23.5°, angle B is about 90°, and angle C is about 66.5°. In an embodiment, swing aid 300 is configured to maintain angle A, angle B, and angle C at a consistent value through the motion of the user's club or bat movement.

This written description uses examples to disclose the invention, including the best mode, and also to enable any person skilled in the art to practice the invention, including making and using any devices or systems and performing any incorporated methods. The patentable scope of the invention is defined in the claims, and may include other examples that occur to those skilled in the art. Moreover, embodiments of the swing aid and methods of use of the swing aid are not be confined to golf swings and baseball bat swings, but are applicable to any vocation incorporating swinging a sport stick. Advantageously, the swing aid causes the user to maintain an angle of approximately in the inclusive range of 23° to 24°, and in an embodiment, causes the user to maintain an intra-arm angle conforming to the obliquity (axial tilt) of the earth relative to its axis. Advantageously, embodiments fabricated from resilient materials allow the user to sustain a critical angle that substantially conforms to the obliquity the earth exhibits as it revolves about the sun annually.

What is claimed is:

1. A swing aid, comprising:

a trailing member formed of an elastic material and defining a trailing member axis;

a leading member formed of an elastic material and defining a leading member axis; and a joining member coupling the trailing member to the leading member such that the trailing member axis intersects the leading member axis at an axes intersection point, the axes defining a critical angle between the trailing member and the leading member, the joining member having a top section and a bottom section, the trailing member and leading member disposed between the top section and bottom section and coupled one to the other and to at least one of the top section and the bottom section, wherein the critical angle is an obtuse angle.

2. The swing aid of claim 1, wherein the critical angle is within the range greater than or equal to about 151.5° and less than or equal to about 161.5°.

3. The swing aid of claim 1, wherein the critical angle is within the range greater than or equal to about 155.5° and less than or equal to about 157.5°.

4. The swing aid of claim 1, wherein the critical angle comprises an angle of about 156.5°.

5. The swing aid of claim 1, wherein at least one of the trailing members, leading member, and joining member further comprises an elastic material.

6. The swing aid of claim 1, wherein the trailing member, leading member, and joining member comprise an elastic strap.

7. The swing aid of claim 1, wherein each of the top section and bottom section of the joining member defines a hexagonal polygon a first angle, a second angle, a third angel, a fourth angle, a fifth angle, and a sixth angle.

8. The swing aid of claim 7, wherein the second angle is about 156.5° and the fifth angle is about 156.5°.

9. The swing aid of claim 8, wherein the first, third, fourth, and sixth angles are about 90°.

10. The swing aid of claim 1, wherein the joining member further comprises at least one orientation indicia.

11. The swing aid of claim 1, wherein the swing aid is configured to control both a left-handed swing, and when reversed, control a right-handed swing.

12. A swing aid, comprising:

a trailing member formed of an elastic and defining a trailing member axis;

a leading member formed of an elastic and defining a leading member axis; and a joining member coupling the trailing member to the leading member such that the trailing member axis intersects the leading member axis at an axes intersection point and defining a critical angle between the trailing member and the leading member, the joining member having a top section and a bottom section, the trailing member and leading member disposed between the top section and bottom section and coupled one to the other and to at least one of the top section and the bottom section, wherein at least one of the leading member and the trailing member further comprises:

a first strap having a fixable surface, and a second strap having an opposed fixable surface, wherein the fixable surface and the opposed fixable surface are configured to cooperatively define an aperture extending through the at least of the leading member and trailing member.

13. The swing aid of claim 12, wherein at least one of the fixable surface and the opposed fixable surface comprise Velcro.

14. The swing aid of claim 12, wherein the fixable surface and fixable surface are configured to define a variable diameter aperture in the at least one of the leading member and trailing member.

15. The swing aid of claim 12, wherein the critical angle is within the range greater than or equal to 151.5° and less than or equal to 161.5°.

16. The swing aid of claim 12, wherein the critical angle is within the range greater than or equal to 155.5° and less than or equal to 157.5°.

17. The swing aid of claim 12, wherein the critical angle comprises an angle of about 156.5°.

* * * * *